United States Patent [19]

Hoffa

[11] 4,383,592

[45] May 17, 1983

[54] ESCAPE LADDER

[76] Inventor: Kenneth R. Hoffa, 4936 Culver, Dearborn Heights, Mich. 48127

[21] Appl. No.: 247,359

[22] Filed: Mar. 25, 1981

[51] Int. Cl.[3] ..... E06C 9/14; E06C 1/56

[52] U.S. Cl. ..... 182/70; 182/196

[58] Field of Search ..... 182/70, 73, 74, 76, 182/196, 197, 198, 199, 163, 164

[56] References Cited

U.S. PATENT DOCUMENTS

| | | | |
|---|---|---|---|
| 204,299 | 5/1878 | Cross | 182/74 |
| 260,627 | 7/1882 | Townsend et al. | 182/76 |
| 303,638 | 8/1884 | Hall | 182/178 |
| 595,082 | 12/1897 | Smoot | 182/73 |
| 755,666 | 3/1904 | Horton | 182/70 |
| 3,344,886 | 10/1967 | Boscarino | 182/70 |
| 4,127,184 | 11/1978 | Strohmeyer | 182/70 |
| 4,211,306 | 7/1980 | Brenner | 182/76 |
| 4,243,121 | 1/1981 | Kiss | 182/196 |

*Primary Examiner*—Reinaldo P. Machado

*Attorney, Agent, or Firm*—Barnes, Kisselle, Raisch, Choate, Whittemore & Hulbert

[57] ABSTRACT

An escape system for multi-story buildings comprising ladder units secured to the building at successive levels thereof adjacent an exit opening such as a window. Each unit comprises a housing and a collapsible ladder section having one end anchored therein and an actuating lever accessible from the window or to a person on the ladder section above for releasing the ladder section so that it falls by gravity to an extended position reaching to the next lower ladder unit. The lower end of a ladder section can be secured to the upper end of the ladder section in the next lower unit.

9 Claims, 10 Drawing Figures

FIG. 6
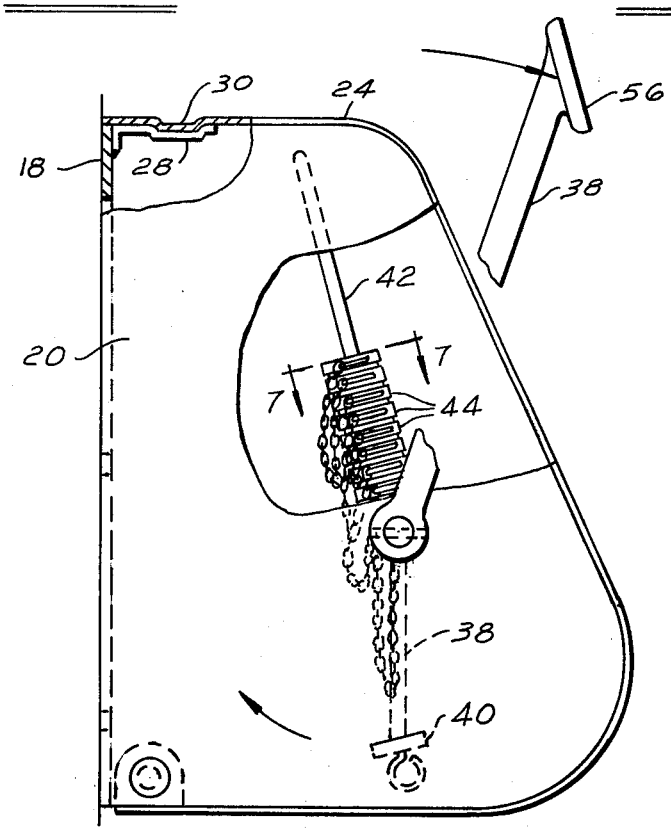
FIG. 10
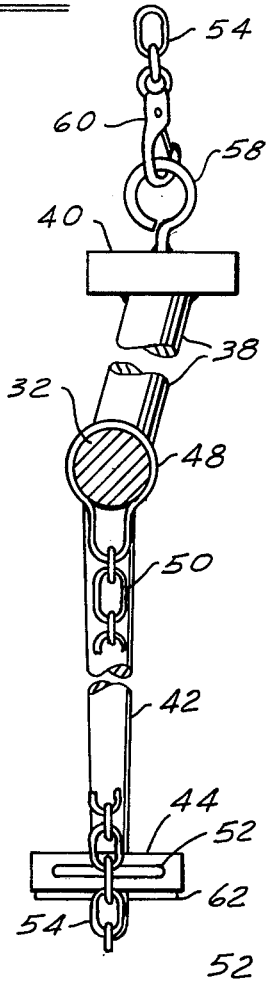
FIG. 7
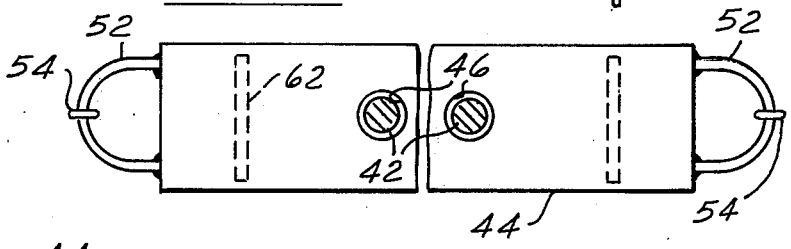
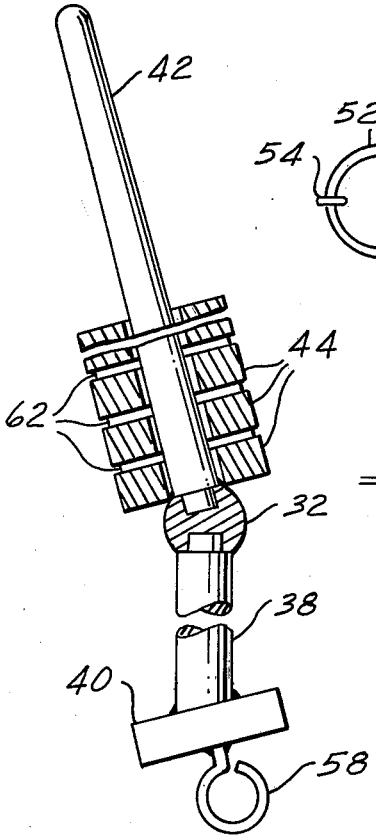
FIG. 8
FIG. 9
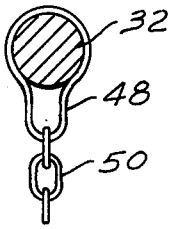

ESCAPE LADDER

BACKGROUND OF THE INVENTION

In the event of fire in a high-rise building such as a hotel or office building, it is frequently impossible for occupants to escape by elevator or stairway or to be reached by the extension ladders used by fire departments. The present invention provides an escape system for use in such buildings which is readily accessible to an occupant of the building and easily operated to form an escape ladder extending down the outside of the building to the ground or other place of safety or at least to a level which can be reached by an extension ladder.

SUMMARY OF THE INVENTION

An escape ladder for use on multi-story buildings comprising a series of ladder units adapted to be secured to the outside wall of the building in vertical alignment, each adjacent an exit opening at each floor level. Each of the ladder units comprises a fixed housing, a collapsible ladder section stored within the housing, means anchoring the one end of the ladder section within the housing, and means to release the ladder section from its stored condition to allow it to fall by gravity to an extended position reaching to the ladder unit at the next lower level.

IN THE DRAWINGS

FIG. 6 is a side elevational view of the unit with parts broken away.

FIG. 7 is a top plan view of one of the steps employed in the unit taken on line 7—7 of FIG. 6.

FIG. 8 is a sectional view taken on line 8—8 of FIG. 5.

FIG. 9 is a sectional view taken on line 9—9 of FIG. 5.

FIG. 10 is an enlarged sectional view taken on line 10—10 of FIG. 2.

DETAILED DESCRIPTION

Figure 1:
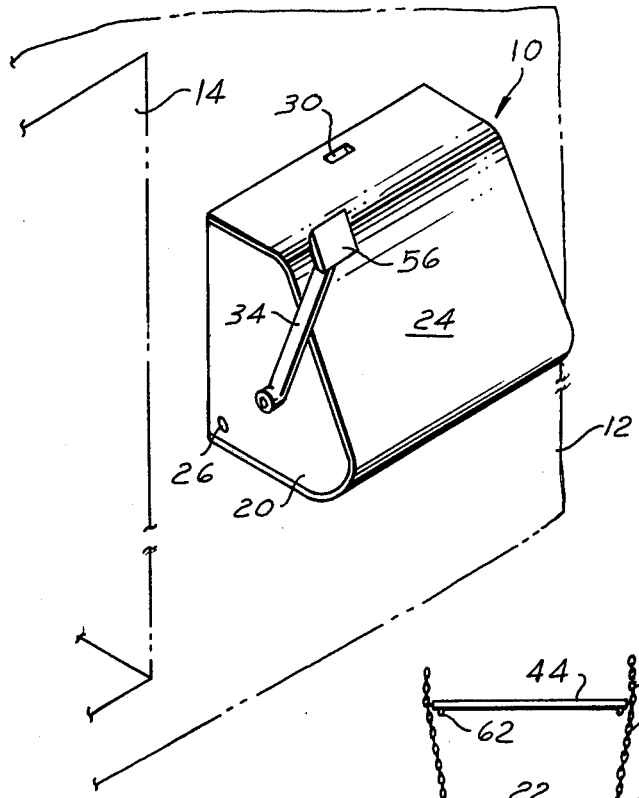
FIG. 1 is a perspective view of a ladder unit of the present invention mounted on a building.

In FIG. 1, there is disclosed a ladder unit 10 secured to the outside wall 12 of a high-rise building such as a hotel. The ladder unit 10 is mounted adjacent an exit opening such as a window 14 where it is easily accessible to an occupant. It is contemplated that a ladder unit 10 will be provided at a window in each room of the building and that the units on successive floors will be in vertical alignment.

Each of the ladder units 10 includes a housing having a back wall 18 and side walls 20 extending outwardly therefrom. The housing may be secured to the building by bolts 22 or in any other suitable manner. A flexible cover 24, preferably made of thin gauge stainless steel, is hinged at its lower end to the side walls 20 by pins 26. The cover is wrapped around the outer edges of the walls 20 of the housing on its closed position and a latch clip 28 secured to the back wall 18 cooperates with an inwardly extending embossment 30 on the cover 24 to hold the cover in its closed position.

Figure 3:
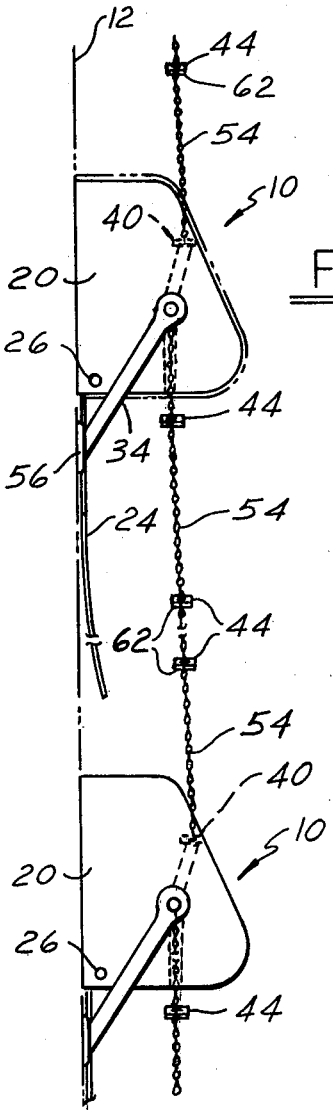
FIG. 3 is a side elevational view of the structure shown in FIG. 2.
Figure 2:
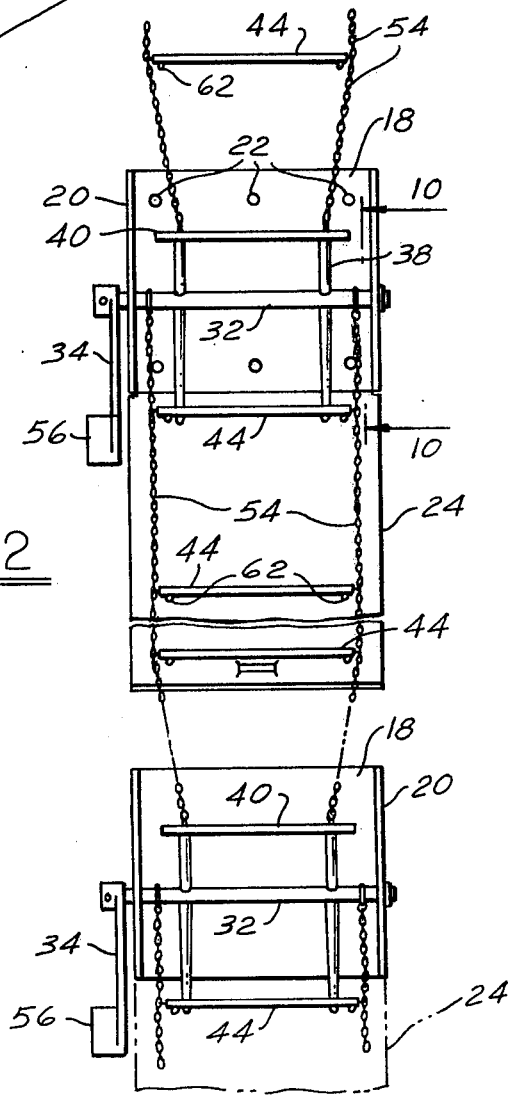
FIG. 2 is a front elevation of a pair of the ladder units on successive levels in their operable position.
Figure 4:
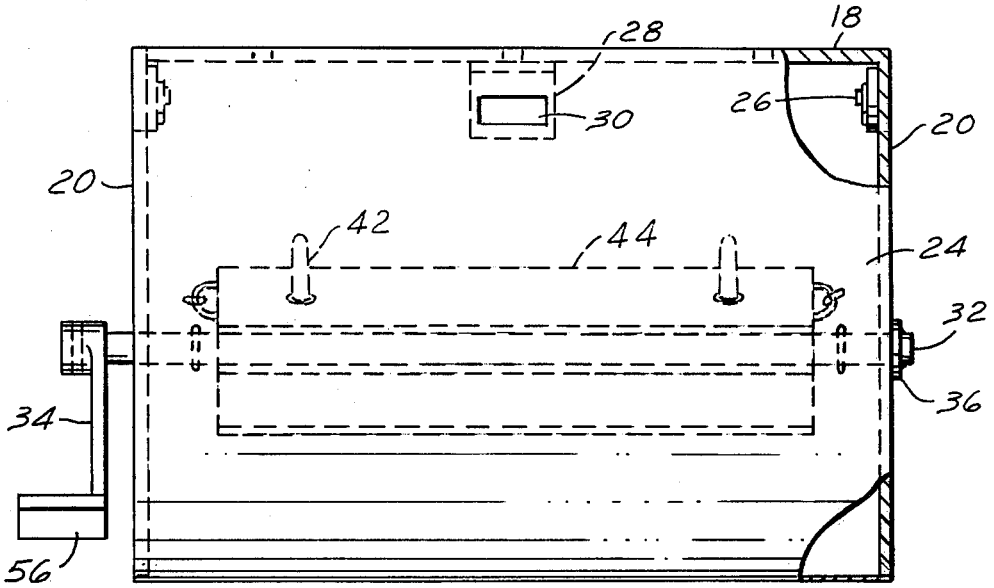
FIG. 4 is a top plan view of a ladder unit of FIG. 1.
Figure 5:
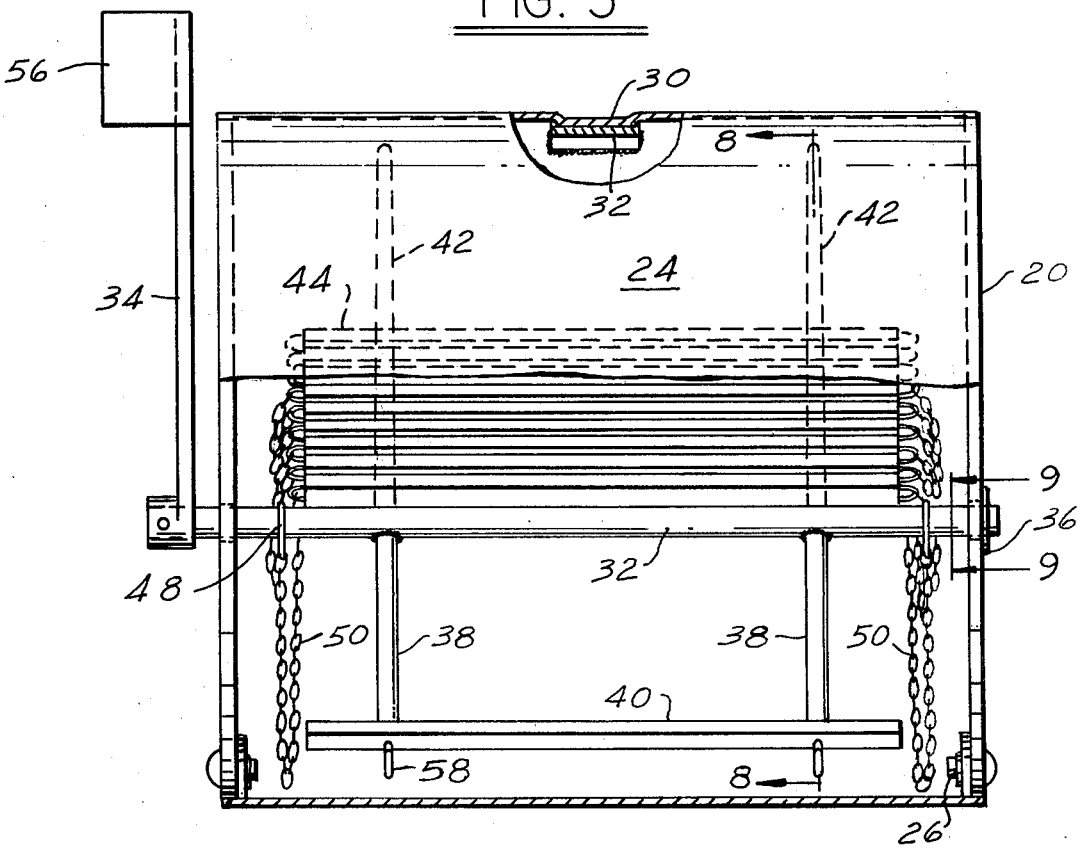
FIG. 5 is a front elevational view of the unit of FIG. 4 with parts broken away.

A collapsible ladder section is stored within each ladder unit 10 and is anchored on a mounting shaft 32 which is journaled in aligned openings in the side walls 20, as shown in FIGS. 4 and 5. The shaft 32 has an actuating lever 34 secured on one end thereof and a washer 36 secured on the other end of the shaft 32 retains the shaft in position. A pair of pins 38 are welded or otherwise secured to the shaft 32 and in the closed or storage position of the ladder unit the pins 38 extend downwardly, as shown in FIGS. 5, 6 and 8. A flat plate or step 40 is secured to the outer ends of pins 38 and forms the top step when the ladder section is in its operable position shown in FIGS. 2, 3 and 10. A pair of support rods 42 are secured to the shaft 32 on the side opposite the pins 38 but extend from the shaft 32 at an angle of about 15° to the axis of the pins 38. In the storage position the rods 42 are inclined toward the building.

A suitable number of steps 44 are stacked on the rods 42. For this purpose the steps each have a pair of holes 46 therein of the same spacing as the rods 42. It will be noted that the rods 42 are of smaller diameter than the holes 46 and are slightly tapered to prevent any binding of the steps 44 as they fall off the rods 42 when the ladder unit is actuated. The shaft 32 has a ring 48 adjacent each end thereof and chains 50 have one end secured to rings 48 and their other ends secured to U-shaped clips 52 mounted on the ends of the first step 44 in the stack of steps mounted on rods 42. Similar lengths of chains 54 extend from the clips 52 of each step 44 to the clips 52 of the next adjacent step.

With the ladder section in the stored condition shown in FIG. 6, the actuating lever 34 extends at a slight angle in a clockwise direction from the vertical, the rods 42 are inclined in the opposite direction, and the pins 38 are substantially vertical. The unit will be approximately balanced on the shaft 32 in this position but if desired a suitable stop or detent (not shown) may be provided to limit any tendency of the shaft to rotate further in a counterclockwise direction, as viewed in FIG. 6. The weight of the stack of steps 44 mounted on the rods 42 will insure that the shaft 32 is not rotated in a clockwise direction inadvertently.

When it is necessary to use the ladder unit, it is only necessary to rotate the actuating lever 34 outwardly and downwardly thereby rotating the shaft 32 and causing the outer ends of the rod 42 to engage the cover plate 24 to release the latch members 28, 30, thus allowing the cover 24 to fall by gravity to the position shown in FIG. 3 in which the cover 24 lies substantially against the outside wall of the building. As the actuating lever 34 moves downwardly, the weight of the steps 44 stacked on the rods 42 will cause the entire unit to pivot to the position shown in FIGS. 2, 3 and 10 in which the rods 42 assume a generally vertical position while the pins 38 are inclined outwardly. The top step 40 is mounted on the ends of pins 38 at an angle such that it will be generally horizontal when the operable position of the ladder unit is reached. It is also to be noted that in this position the foot pedal 56 on the outer end of lever 34 engages against the wall 12 of the building. Due to the outward inclination of the pins 38, the weight of an occupant on step 40 will tend to rotate the shaft 32 in a clockwise direction but is prevented from doing so by engagement of pedal 56 with wall 12. As the steps 44 fall off of the ends of rods 42, the chains 54 position the steps 44 one below the other at an appropriate distance apart.

The stop step 40 of each unit is provided with a pair of eye bolts 58 and the lowermost length of chain 54 of each unit is provided with a clip type fastener 60 which may be snapped onto an eye bolt of the next lower unit.

After an occupant has manipulated the lever 34 of the ladder unit at his floor level, the ladder section therein will fall by gravity as previously described. The occupant then descends the ladder down to the next lower level. The actuating lever 34 and its foot pedal 56 are positioned so that the occupant may easily reach down with one foot and kick or push the foot pedal of the next lower unit outwardly and downwardly to cause the ladder section in such lower unit to fall to its operably position whereupon the occupant merely continues down the ladder thus formed floor by floor until the ground or other position of safety is reached. When an occupant is the first to reach a lower ladder unit he can snap the clips 60 onto the eye bolts 58 as he proceeds down the ladder to form a more stable structure for those who follow.

The steps 44 are provided with rods 62 or the like secured to the undersurface thereof so that when the steps are arranged in a stack, as shown in FIG. 6, the steps will not become frozen together under adverse weather conditions.

It will be seen that by the present invention there is provided an inexpensive and easily operable escape ladder system by means of which occupants of high-rise buildings can escape from the building when normal exits such as stairways or elevators are inaccessible. In buildings having a balcony outside of a door or window the ladder units may be positioned to be readily accessible from the balcony.

I claim:

1. An escape ladder comprising a housing adapted to be secured to an outside wall of a building, a shaft mounted on said housing for rotation between a storage position and an operable position, support means on said shaft and extending generally perpendicular thereto, a series of steps adapted to be stacked on said support means when said shaft is in its storage position, flexible suspension means connecting the first step in the stack to said shaft and successive steps to each other in spaced relation, and an actuating lever for rotating said shaft from said storage position to said operable position whereby said steps are free to fall by gravity from said support means to form a ladder supported from said shaft.

2. A ladder according to claim 1 including a top step fixedly mounted on said shaft and adapted upon rotation of said shaft to said operable position, to rotate to a position above said shaft to form the top step of said ladder.

3. A ladder according to claim 2 wherein said support means extends upwardly from said shaft when the ladder is in said storage position and is inclined in a direction to resist rotation of said shaft to its operable position.

4. A ladder according to claim 3 wherein said actuating lever extends upwardly from said shaft so as to be accessible to a person descending a similar ladder unit positioned above said ladder.

5. A ladder according to claim 3 including a cover plate for said housing adapted to be releasably secured thereto, and means operable upon rotation of said shaft for releasing said cover plate.

6. A ladder according to claim 5 wherein said support means comprises a pair of rods secured to said shaft, and said steps are provided with apertures receiving said rods in said storage position.

7. An escape ladder for use on a multi-story building comprising a series of ladder units adapted to be secured to the outside wall of the building in vertical alignment adjacent an exit opening at each floor level, each of said units comprising a fixed housing, a collapsible ladder section stored within said housing, said ladder section comprising a shaft mounted on said housing for rotation between a storage position and an operable position, support means on said shaft and extending generally perpendicular thereto, a series of steps adapted to be stacked on said support means when said shaft is in its storage position, flexible suspension means connecting the first step in the stack to said shaft and successive steps to each other in spaced relation, and an actuating lever for rotating said shaft from said storage position to said operable position whereby said steps are free to fall by gravity from said support means to form a ladder supported from said shaft and reaching to the ladder unit at the next lower floor.

8. An escape ladder according to claim 7 including means to secure the lower end of a ladder section to the upper end of the next lower unit in the series.

9. An escape ladder according to claim 8 wherein said means to release said ladder section comprises a foot operated lever accessible to a person on the next higher ladder section and to an occupant at the level of said ladder unit.

* * * * *